US005916102A

United States Patent [19]

Peyton

[11] Patent Number: 5,916,102

[45] Date of Patent: Jun. 29, 1999

[54] REMOVABLE TILE DISPLAY

[75] Inventor: Alan Peyton, Wilmot, Wis.

[73] Assignee: Glaazart U.S.A., Inc., Wilmot, Wis.

[21] Appl. No.: 09/013,616

[22] Filed: Jan. 26, 1998

[51] Int. Cl.[6] ..... E04F 13/08

[52] U.S. Cl. ..... 52/385; 52/384; 52/311.2; 52/311.3; 52/390

[58] Field of Search ..... 52/311.2, 311.3, 52/384, 390, 392, 387; 81/45, 46, 436, 438, 451, 456, 485; 294/6, 17, 26; 125/36, 37, 38, 41

[56] References Cited

U.S. PATENT DOCUMENTS

| | | | |
|---|---|---|---|
| 421,741 | 2/1890 | Marsh . | |
| 421,742 | 2/1890 | Marsh . | |
| 636,200 | 10/1899 | Frink . | |
| 910,586 | 1/1909 | Ross et al. . | |
| 1,218,145 | 3/1917 | Whittier . | |
| 1,836,964 | 12/1931 | Grigsby et al. . | |
| 2,114,710 | 4/1938 | Holcomb . | |
| 2,852,932 | 9/1958 | Cable . | |
| 2,908,049 | 10/1959 | Gold . | |
| 3,335,048 | 8/1967 | Morain . | |
| 3,515,611 | 6/1970 | Muhlberg et al. . | |
| 4,353,193 | 10/1982 | Sanderson . | |
| 4,388,788 | 6/1983 | Bosco | 52/390 |
| 4,554,769 | 11/1985 | Fujii et al. | 52/173 |
| 4,567,704 | 2/1986 | Bernett et al. | 52/309.3 |
| 4,577,444 | 3/1986 | Sanderson . | |
| 4,698,249 | 10/1987 | Brown | 428/44 |
| 4,804,569 | 2/1989 | Arisawa . | |
| 4,953,341 | 9/1990 | Joos | 52/747 |
| 4,996,784 | 3/1991 | Hsu . | |
| 5,208,924 | 5/1993 | Smith et al. . | |
| 5,238,721 | 8/1993 | Nakazawa | 428/44 |
| 5,253,439 | 10/1993 | Shanok et al. . | |
| 5,271,200 | 12/1993 | Witt | 52/391 |
| 5,280,676 | 1/1994 | Fieni | 30/172 |
| 5,495,781 | 3/1996 | Wirth | 81/45 |
| 5,533,288 | 7/1996 | Lambert . | |
| 5,590,500 | 1/1997 | McCue . | |
| 5,673,532 | 10/1997 | Jennings et al. | 52/742.16 |
| 5,813,295 | 9/1998 | Jensen, Jr. | 81/45 |

*Primary Examiner*—Carl D. Friedman
*Assistant Examiner*—Yvonne Horton-Richardson
*Attorney, Agent, or Firm*—Larry L. Saret; Laff, Whitesel & Saret, Ltd.

[57] ABSTRACT

A removable tile display includes a decorative tile, a holder for the tile, and releasable adhesive for removably securing the back surface of the tile to the holder. The holder includes a cavity in which the decorative tile is positioned. Decorative tiles of various designs may be substituted within the holder as desired. The tile and holder combination may be permanently affixed to a wall or other planar surface, or they may be placed for vertical orientation within a tabletop support.

13 Claims, 6 Drawing Sheets

REMOVABLE TILE DISPLAY

BACKGROUND OF THE INVENTION

The invention relates to a display for holding a decorative tile and, more particularly, to a display in which the tile can be easily removed and replaced with a different decorative tile.

Decorative tiles, such as those made of ceramic, glass or stone, are typically displayed in one of two ways: permanently affixed to a wall surface with cement and surrounded by grout, or within a wooden or metal frame for use as a hot plate or as a work of art, such as a wall hanging. In either case, the particular decorative tile, once chosen, cannot practically be replaced within the same frame. In the case of a tile affixed to a wall, replacement requires chipping away the grout surrounding the decorative tile, prying the tile away from the underlying wall, and hoping that the wall and surrounding tiles are not damaged. In the case of a framed tile, replacement requires breaking the adhesive or removing the hardware or other mechanical means holding the tile within the frame and hoping that the tile and frame are not damaged in the process.

There are various reasons for replacing a tile. A tile may be chipped, cracked or otherwise damaged. The color scheme or look of a room may change, so a different tile may be desired for aesthetic reasons. A decorative tile may have a particular theme or seasonal message, such as "Merry Christmas" or "Happy Halloween", so it may be desirable to change the tile at different times of year. For any or all of these reasons, it is desirable to be able to change a selected tile or tiles from time to time.

A problem with integrating prior replaceable tile devices, such as that described in U.S. Pat. No. 5,590,500, into a wall covered with conventional tiles is the material incompatibility of the decorative tile frame or holder and the grout used around conventional ceramic tiles. Grout and ceramic tile are similar materials in that they are composed of earth and water and, consequently, they expand and contract with temperature to a similar extent, and they also readily adhere to one another. Elastomeric materials, rigid rubber or plastic compounds, such as those used for the frame disclosed in U.S. Pat. No. 5,590,500 and other materials dissimilar to grout and ceramic expand, contract, and adhere differently than grout and ceramic. As a result, should such dissimilar frames be installed on a wall surrounded by conventional grout and ceramic tile, the frames will soon separate from the surrounding grout and present an unsatisfactory appearance.

Thus, there is a need for a removable tile display in which the decorative tile can be easily inserted, firmly held for an extended time period, and when desired, replaced with another tile without damage to the tile, the tile holder or underlying surface. There is also a need for a removable tile display which can be integrated into a wall covering composed of conventional ceramic tile and grout.

SUMMARY OF THE INVENTION

A removable tile display according to the invention includes a decorative tile and a holder for the tile. The holder includes a base having flat, parallel, inside and outside surfaces and one or more upstanding walls framing the base. Together, the upstanding walls and the inside surface of the base form a cavity for receiving the tile. The tile has a generally flat back surface and a decorative front surface, with edges extending between the back and front surfaces. A releasable adhesive, such as tape, is inserted between the inside surface of the holder and the back surface of the tile to firmly but removably hold them together. The decorative tile is positioned within the cavity so that there is a small gap between the edge of the tile and an upstanding wall of the holder. A tool can be inserted into the gap and between the back surface of the tile and the cavity to pry the tile away from the holder, so that it is easy to separate the tile and holder when a different tile is desired. To insert a new tile into the holder and centrally position it within the cavity, an installation spacer bar can be affixed to the tool and positioned along the inside of the cavity and abutting an upstanding wall. Because the installation spacer bar has a height to match the desired gap between the tile and upstanding wall, the tile merely needs to be positioned flush against the spacer bar, and in this manner, the tile is centrally located.

The tile and holder can then be affixed to a wall or a countertop or mounted upright on a table with a stand. If affixed to a wall or countertop, the outside surface of the base of the holder can be cemented to the wall or underlying counter surface, and the external sides of the holder can be surrounded with grout and other tiles to appear built-in or as part of an overall tile design.

These and other features and advantages of the invention will become apparent from the following Detailed Description of the Preferred Embodiments, taken in conjunction with the accompanying drawings which illustrate the principles of the invention.

DETAILED DESCRIPTION OF THE PREFERRED EMBODIMENTS

Figure 1:
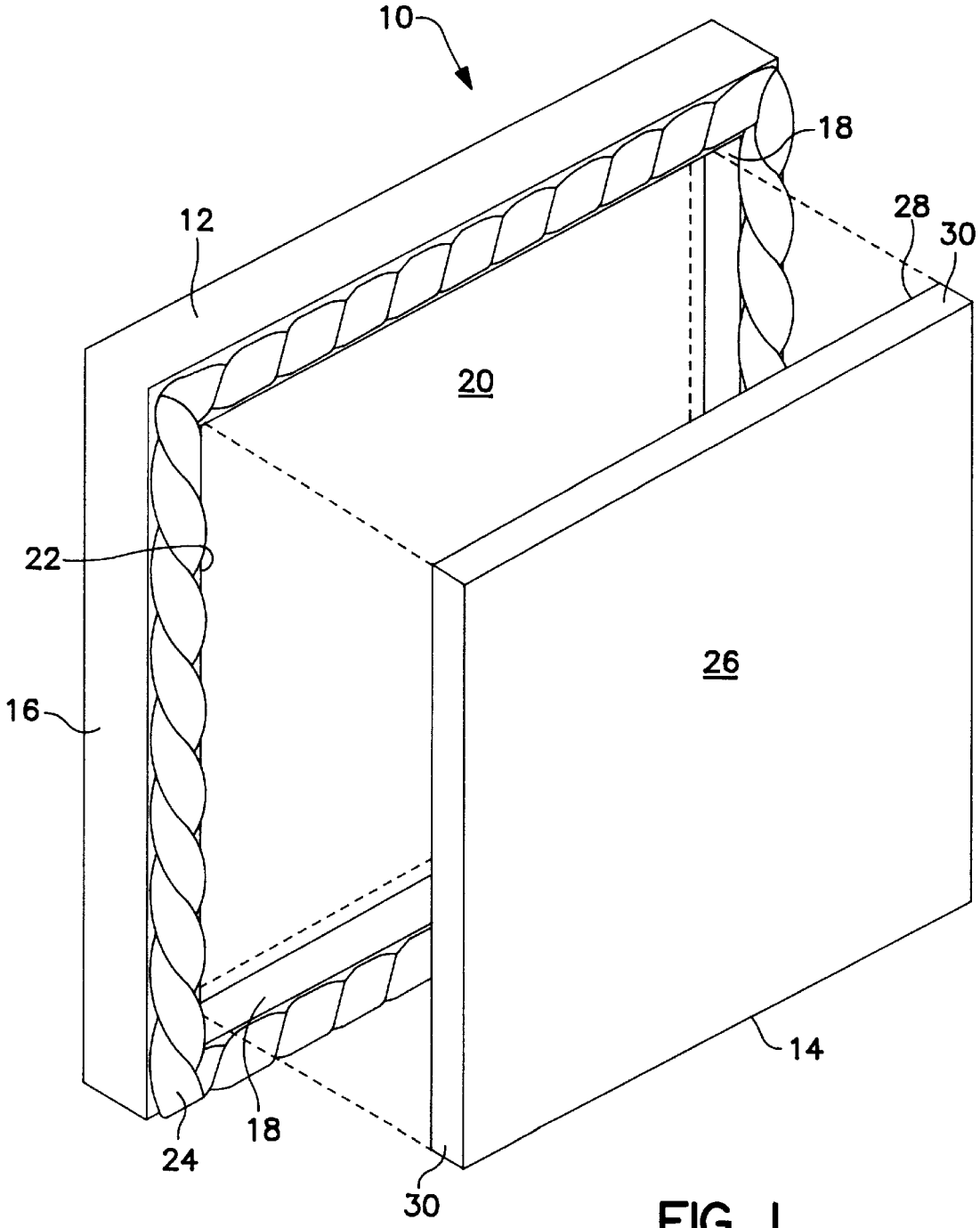
FIG. 1 is an exploded perspective view of a holder and decorative tile according to the invention.

The inventive removable tile display 10 includes a holder 12 and a tile 14 (FIG. 1). The holder 12 includes a base 16 framed by upstanding walls 18. Because the holder is preferably generally rectangular in cross section, there are preferably four upstanding walls 18. The inside surface 20 of base 16 and the upstanding walls 18 together define a cavity 22. The cavity is geometrically configured and dimensioned to receive tile 14 so that it lies above inside surface 20 and is surrounded by upstanding wall 18. The upstanding wall may optionally be trimmed in a decorative manner, such as the rope design 24 of FIG. 1. Holder 12 is composed of ceramic and may be formed by conventional processes. Desirably, the upstanding walls 18 including the design 24 and the inside surface 20 are glazed, while the outside surface 32 of base 16 is not glazed (FIG. 2).

Tile 14 is preferably composed of ceramic and has a decorative surface 26, a rear surface 28, and peripheral edges 30 which, the case of a rectangular tile as shown in FIG. 1, extend on four sides between rear surface 28 and decorative surface 26. Tile 14 is positioned within cavity 22 so that its rear surface 28 faces inside surface 20 of the base and peripheral edges 30 are surrounded by upstanding walls 18. Decorative surface 26 of tile 14 remains visually exposed even when tile 14 is nested in holder 12, and decorative surface 26 can have any pleasing color or design. Desirably, rear surface 28, decorative surface 26, and edges 30 of tile 14 are glazed.

Figure 2:
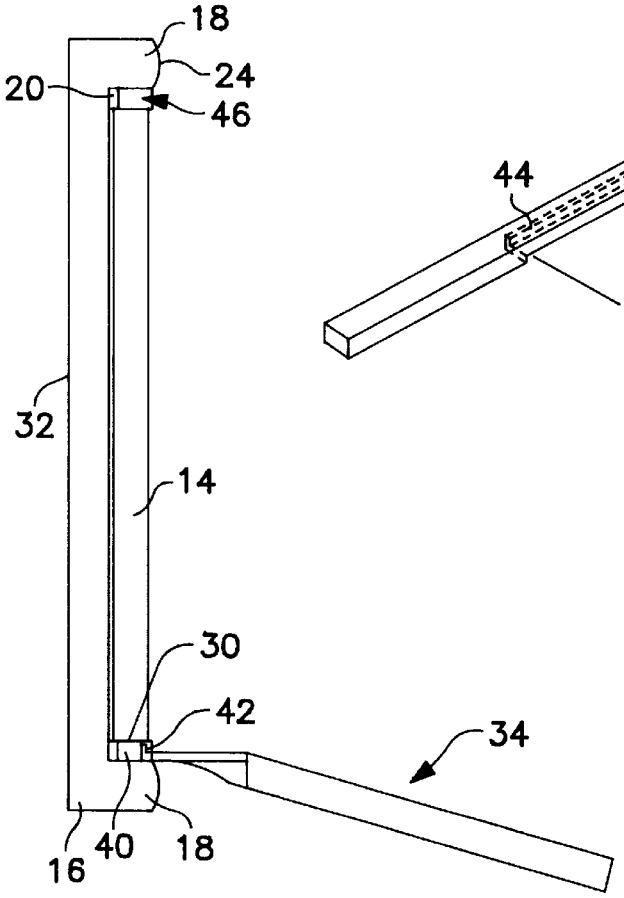
FIG. 2 is a cross-sectional view of the decorative tile and holder of FIG. 1 with a spacer bar and tool for positioning the decorative tile within the holder, with the lip of the tool shown in phantom lines.
Figure 3:
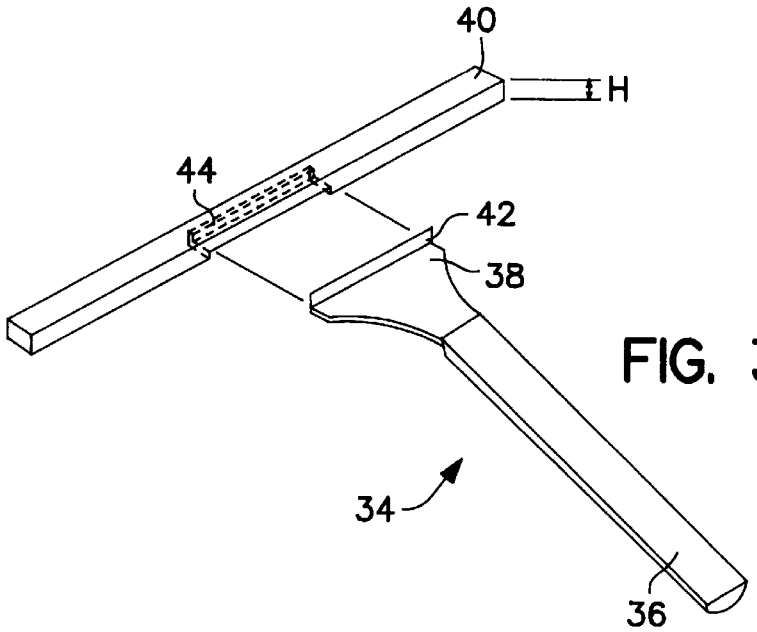
FIG. 3 is an exploded perspective view of the spacer bar and tool, with the slot of the spacer bar in phantom lines.

The preferred positioning of the tile 14 within the cavity 22, and the means for facilitating this positioning, are shown in FIGS. 2 and 3. As shown in FIG. 2, a decorative tile 14 has been inserted against inside surface 20 of base 16. A tool 34 having an elongated handle 36 and a prying end 38 with a generally transversely oriented lip 42 is joined with an installation spacer bar 40 by press-fitting lip 42 into a mating slot 44 in spacer bar 40. The spacer bar has a generally rectangular cross-section and a height H which matches the desired gap 46 to be left between the peripheral edges 30 of tile 14 and upstanding walls 18 of holder 12. By using tool 34 to insert the spacer bar 40 into cavity 22 and against an upstanding wall 18, and by locating a peripheral edge 30 against spacer bar 40, the proper size gap can be determined. Once the gap is determined, the spacer bar 40 and tool 34 are removed. This process can be repeated as needed for each peripheral edge 30.

Figure 4:
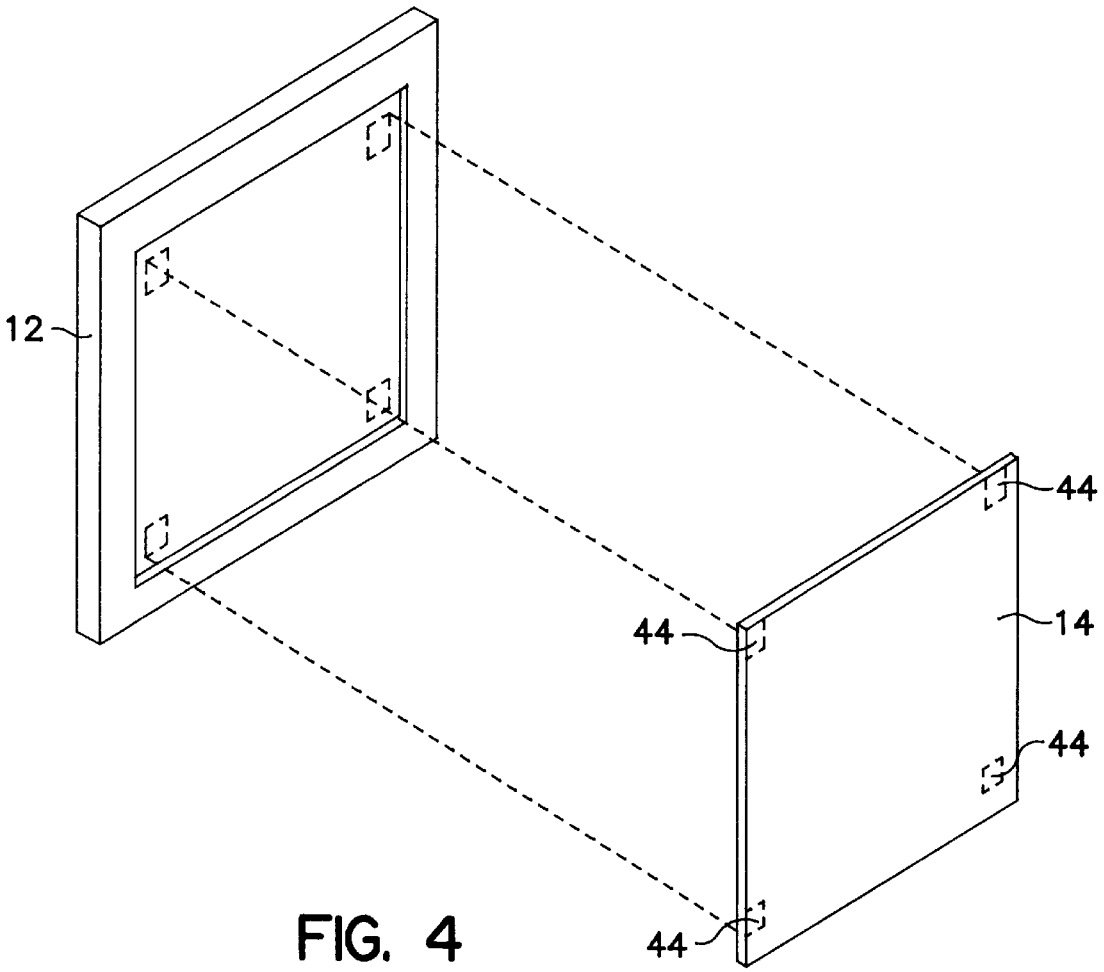
FIG. 4 is an exploded perspective view of a decorative tile and holder with adhesive tapes between them.

Once tile 14 is properly located within cavity 22, it must be secured to the holder 12. FIG. 4 shows the use of tape strips 44 having a releasable adhesive coating to affix tile 14 to holder 12. Other inconspicuous means for releasably affixing tile 14 to holder 12, such as a releasable adhesive coating (not shown) on the tile 14 or holder 12, may be used.

Figure 5:
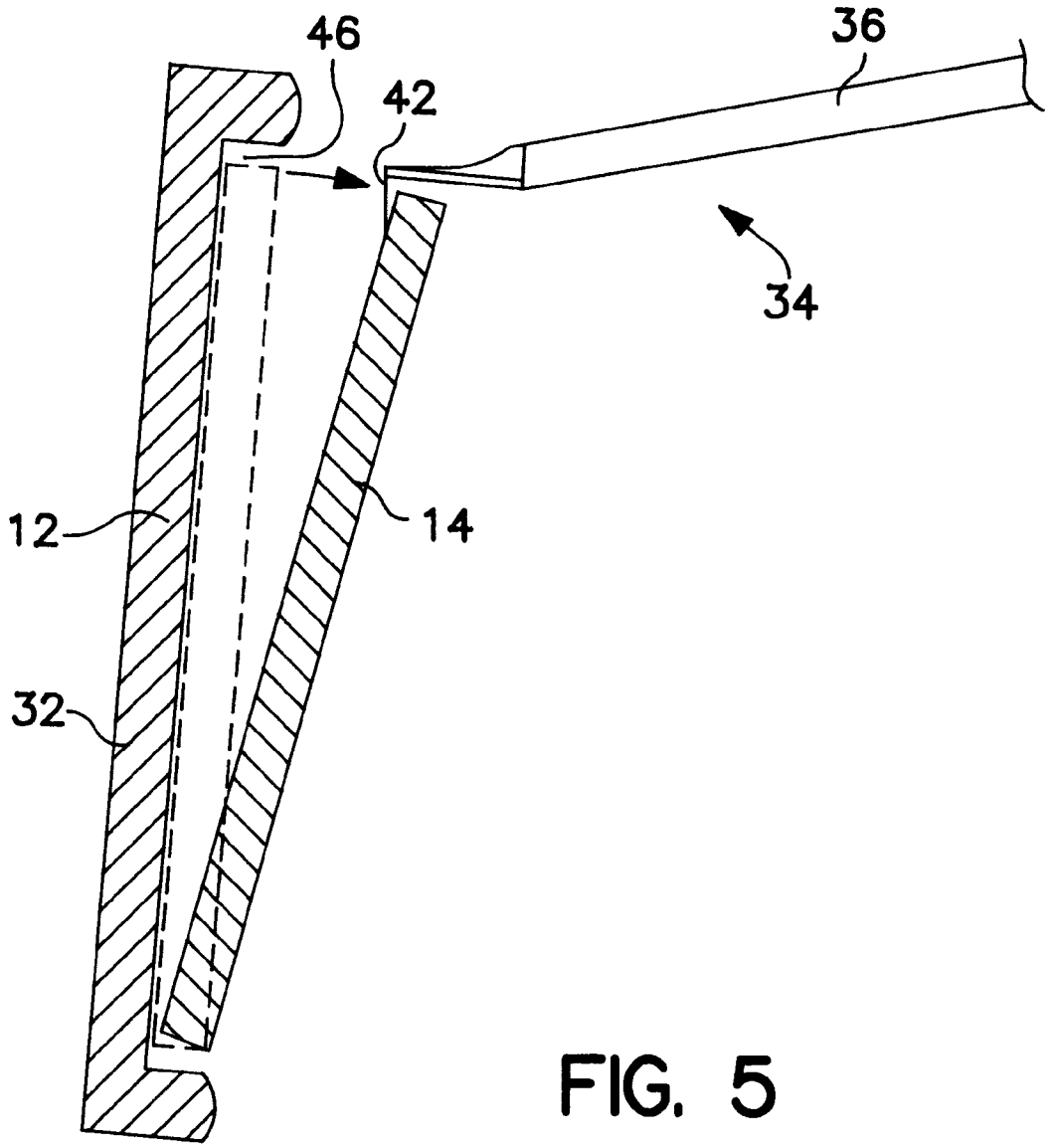
FIG. 5 is a cross-sectional view of the decorative tile and holder of FIG. 1 with the tool removing the decorative tile from its original position as shown in phantom lines.

Removal of a tile 14 from holder 12 is best shown in FIG. 5. Tool 34 is inserted into a gap 46 so that lip 42 engages the rear surface 28 of tile 14. By gently tugging on handle 36, the adhesive holding the tile to the holder can be broken and the decorative tile 14 removed from the holder, thereby permitting insertion of another tile into the holder.

Figure 6:
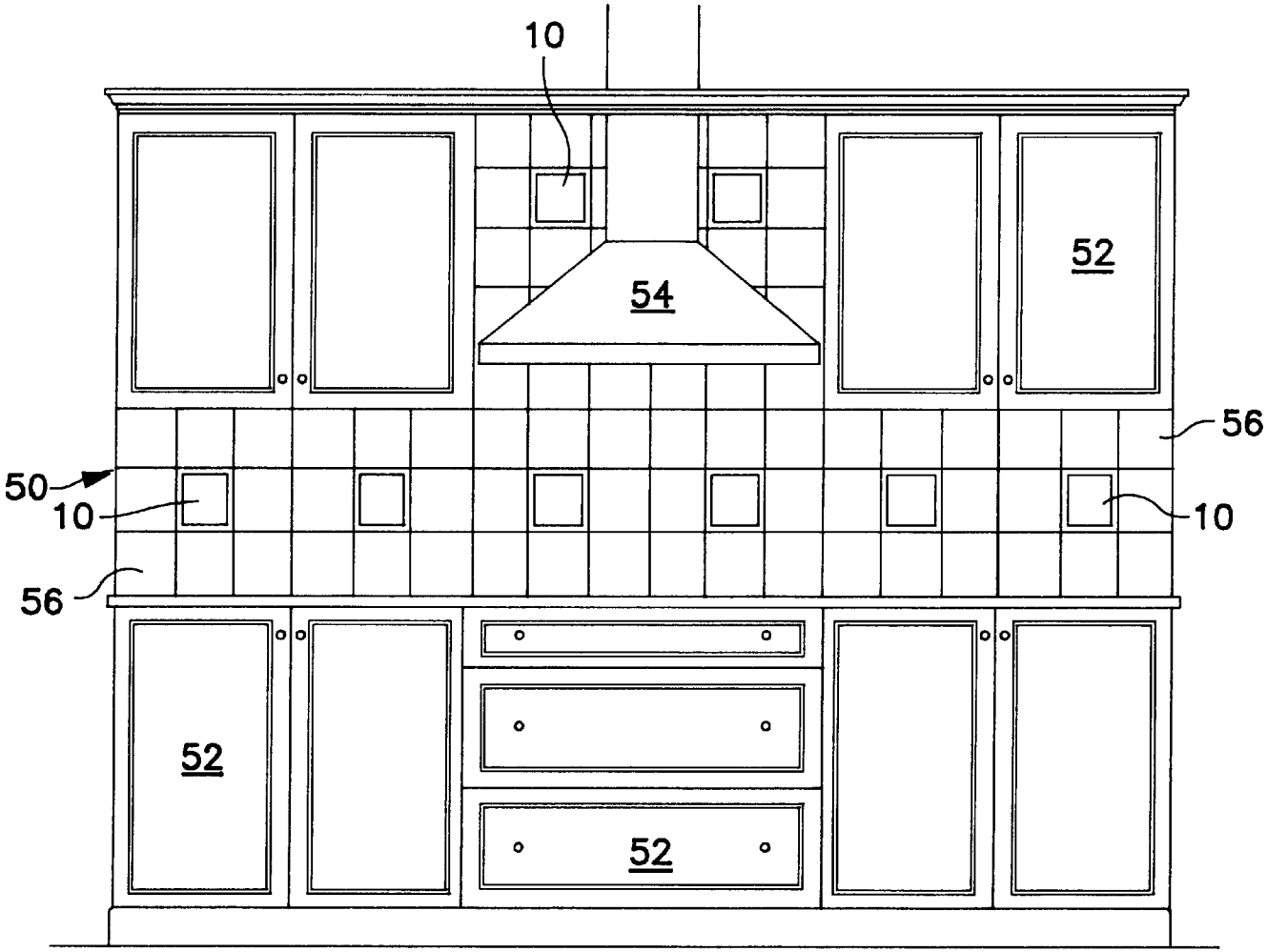
FIG. 6 is an elevation view of a kitchen wall showing multiple holders and decorative tiles integrated into a wall covered by conventional tiles, cabinets, and fixtures.

The removable tile display may be affixed to a wall and integrated into a conventional tile wall covering, as shown in FIG. 6. By way of example, a wall 50 supports various cabinets 52, a cooktop exhaust 54, and a plurality of conventional tiles 56. The conventional tiles 56 are spaced at multiple locations to leave openings on the wall for removable tile displays 10, which, as shown in FIG. 6, are typically integrated into the overall wall covering design by permanently securing the flat outside surface 32 of base 16 to wall 50 with a suitable adhesive. The removable tile display may similarly be affixed to a planar surface other than a wall, such as a countertop or table (not shown).

Figure 7:
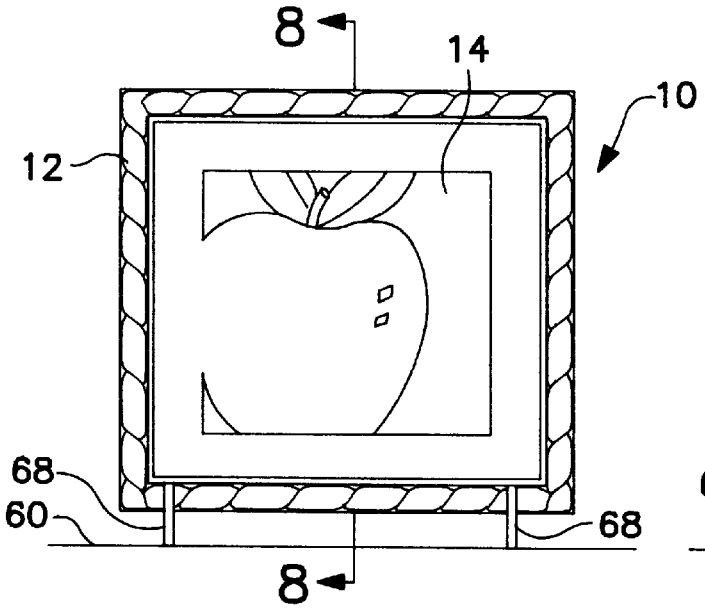
FIG. 7 is an elevation view of a second embodiment of the invention adapted for tabletop use.
Figure 8:
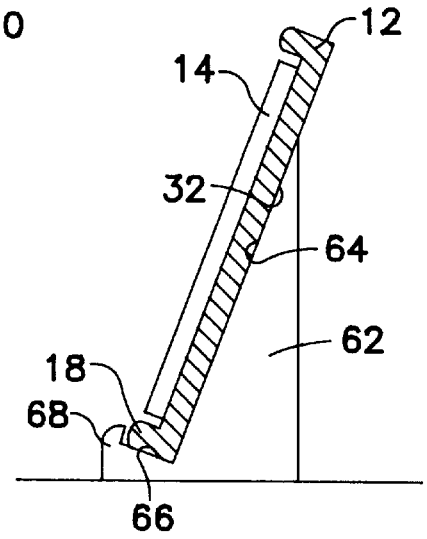
FIG. 8 is a cross-sectional view of the second embodiment of the invention taken along line 8—8 of FIG. 7.

Another embodiment of the removable tile display is shown in FIGS. 7 and 8. The removable tile display 10 is designed for use on a tabletop 60 by adding a support 62 to receive and orient the display in a generally vertical position on a table 60 or other generally horizontal surface. The table support 62 includes a backstop 64 to support the outside surface 32 of base 16 of holder 12, and a floor 66 oriented at an angle relative to the backstop and upon which rests an upstanding wall 18 of holder 12. A pair of retaining legs 68 extend generally perpendicularly from floor 66 to keep the holder 12 from sliding forward and out of table support 62.

The inventive removable tile display may be constructed in a variety of geometric shapes and dimensions. In one form, the holder was square with approximate dimensions of 5⅞ inches per side, and the upstanding walls were ⅜ of an inch thick and ⅜ of an inch above the inside surface 20 of base 16. Thus, cavity 22 was approximately 5⅛ inches square and ⅜ of an inch deep. An appropriate tile 14 would be 4⅞ square and 5/16 of an inch thick, leaving the tile's decorative surface 26 just below the top of upstanding walls 18 and a gap of ⅛ of an inch between each edge and the nearest upstanding wall 18.

Although the invention has been described with reference to preferred embodiments, it should be understood by those skilled in the art that the invention is not limited to those embodiments. Rather, changes to the details of the embodiments may be made without departing from the spirit and scope of the invention as claimed.

The invention claimed is:

1. A removable tile display comprising:

a tile having a back surface, a decorative surface, and at least one edge between said decorative surface and said back surface;

a holder for mounting said tile, said holder including a base and at least one upstanding wall framing said base, said base and upstanding wall defining a cavity for receiving said tile, said upstanding wall spaced apart from said tile edge; and releasable adhesive between said back surface of said tile and said base for removably securing said back surface of said tile to said holder so as to maintain the spacing between said tile edge and said upstanding wall.

2. The tile display of claim 1 wherein said holder is ceramic.

3. The tile display of claim 1 wherein said at least one edge extends around the entire periphery of said tile, and wherein a gap exists between said at least one edge and said at least one upstanding wall around the entire periphery of said tile.

4. A removable tile display system comprising:

a tile having an edge and a back surface;

a ceramic holder for said tile, said holder having a base and an upstanding wall framing said base, said base and upstanding edge together forming a central cavity in said holder for receiving said ceramic tile, said ceramic tile dimensioned so that there is a gap between said ceramic tile edge and said upstanding wall of said holder;

a releasable adhesive between said back surface of said tile and said base for removably securing said tile to said holder so as to maintain the gap between said ceramic tile edge and said upstanding wall; and a tool for insertion into said gap between said tile and said holder to help separate said tile from said holder in order to permit insertion of another tile.

5. The tile display system of claim 4 wherein said tool has a lip dimensioned to fit between said tile and said holder so as to pry them apart.

6. The tile display of claim 5 wherein said tool has a handle and a prying end, and said lip extends generally transversely from said prying end.

7. The tile display system of claim 4 and an installation spacer bar for use in determining the proper size gap between said edge of said tile and said upstanding wall during installation of said tile into said central cavity.

8. The tile display system of claim 7 where in said spacer bar has a slot for receiving said tool.

9. The tile display system of claim 7 where in said spacer bar has a height which matches the desired gap between said tile edge and said upstanding wall.

10. The tile display system of claim 4 and a support for receiving said tile and holder and orienting them in a generally vertical position for display on a generally horizontal surface.

11. A removable tile display for affixing to a planar surface, comprising:

a ceramic holder having an upstanding wall defining a central cavity;

a tile having an edge and a back surface, said tile dimensioned to fit within said cavity and leave a gap between said edge and said upstanding wall;

means for releasably securing said back surface of said tile to said holder so as to maintain the gap; and means for permanently securing said holder to a planar surface.

12. The tile display of claim 11 wherein said holder has a base with a first surface and an upstanding wall framing said base and extending above said first surface, said base and upstanding wall together forming said central cavity.

13. The tile display of claim 12 wherein said base has a flat second surface opposite said first surface, said flat second surface for affixing said base to said planar surface.

* * * * *